US006505693B1

(12) United States Patent
Looijen et al.

(10) Patent No.: US 6,505,693 B1
(45) Date of Patent: Jan. 14, 2003

(54) SOIL SAMPLER

(75) Inventors: Peter N. Looijen, Leidschendam (NL); Herman M. Zuidberg, Rijnsburg (NL)

(73) Assignee: Fugro Engineers B.V., Leidschendam (NL)

( * ) Notice: Subject to any disclaimer, the term of this patent is extended or adjusted under 35 U.S.C. 154(b) by 0 days.

(21) Appl. No.: 09/743,669

(22) PCT Filed: Jun. 2, 1999

(86) PCT No.: PCT/NL99/00342

§ 371 (c)(1),
(2), (4) Date: Jan. 10, 2001

(87) PCT Pub. No.: WO00/04238

PCT Pub. Date: Jan. 27, 2000

(30) Foreign Application Priority Data

Jul. 15, 1998 (NL) ..... 1009662

(51) Int. Cl.[7] ..... E21B 25/00
(52) U.S. Cl. ..... 175/249; 175/58; 175/250
(58) Field of Search ..... 175/58, 20, 244, 175/249, 250, 251, 294, 403

(56) References Cited

U.S. PATENT DOCUMENTS

| | | | | |
|---|---|---|---|---|
| 3,955,631 A | * | 5/1976 | Kostylev et al. | |
| 4,002,213 A | * | 1/1977 | Sweeney | |
| 4,518,051 A | * | 5/1985 | Sollie et al. | 175/246 |
| 5,038,873 A | * | 8/1991 | Jurgens | 175/246 |
| 5,777,242 A | * | 7/1998 | Zuidberg et al. | 73/864.45 |

FOREIGN PATENT DOCUMENTS

| | | | |
|---|---|---|---|
| DE | 32 00 881 | * | 7/1983 |
| GB | 298188 | * | 6/1929 |
| GB | 2 142 364 | * | 1/1985 |
| JP | 59145815 | * | 8/1984 |
| WO | WO 94/01653 A1 | * | 1/1994 |

* cited by examiner

*Primary Examiner*—David Bagnell
*Assistant Examiner*—Jennifer R. Dougherty
(74) *Attorney, Agent, or Firm*—Kinney & Lange, P.A.

(57) ABSTRACT

An apparatus for taking a soil sample includes a drill pipe, a first driving gear for introducing the drill pipe into the soil, a sampling bush which movably fits into the drill pipe and a second driving gear for introducing the sampling bush into the soil.

11 Claims, 4 Drawing Sheets

SOIL SAMPLER

Figure 1:
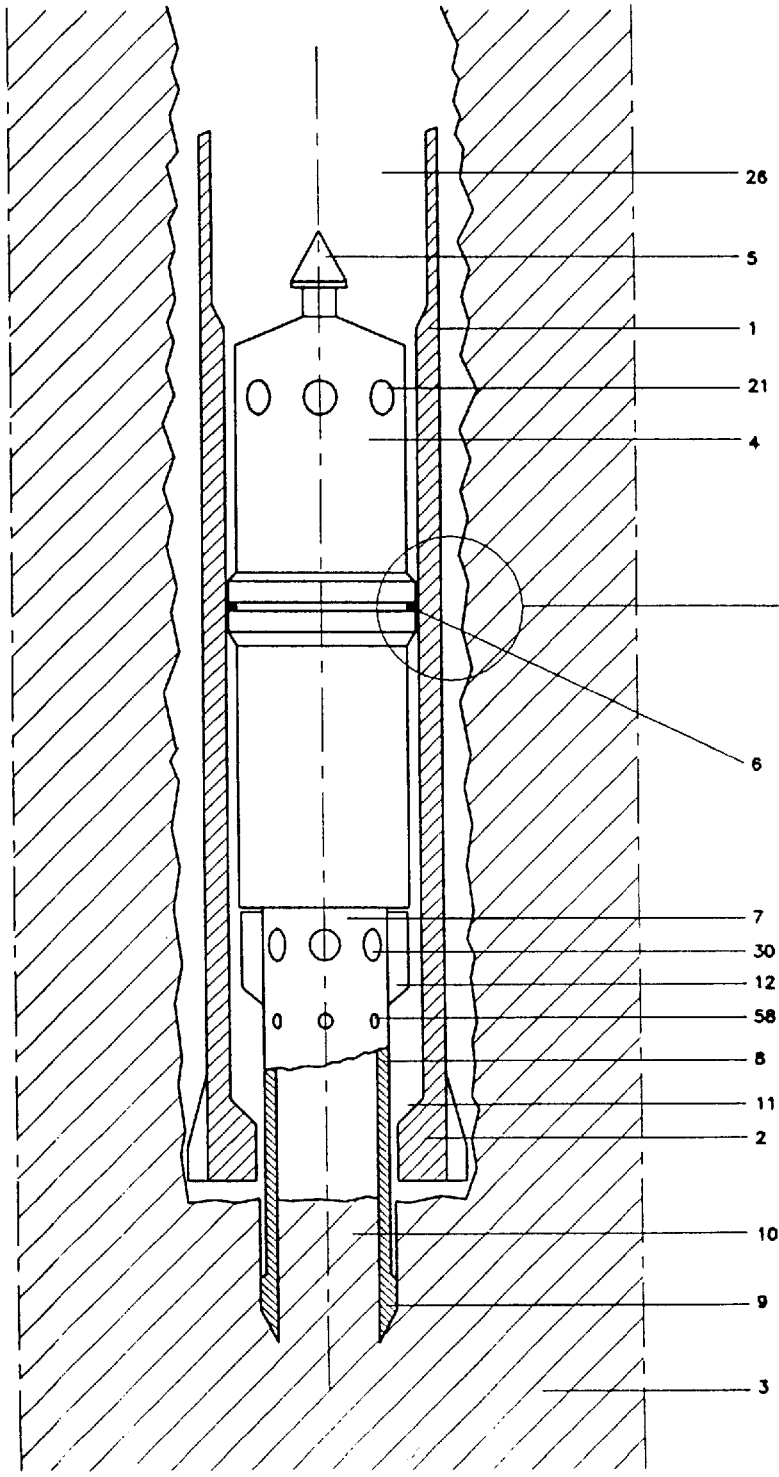

The invention relates to an apparatus for taking a soil sample comprising a drill pipe, a first driving gear for introducing the drill pipe into the soil, a sampling bush which movably fits into the drill pipe and a second driving gear for introducing the sampling bush into the soil.

Such an apparatus is known in practice. Such an apparatus serves for taking soil samples to determine the physical and mechanical properties of the soil for the purpose of, for example, designing foundations, detecting soil pollution, examining the soil's geological history of development, and the like. Such examination is carried out, among other things, by means of drilling holes, taking samples of the sediment in the bottom of the hole. Regularly increasing the depth of the drill hole, provides access to increasingly deeper soil strata each time taking samples in order to obtain a continuous soil profile geared to the requirements.

To obtain said samples, a distinction is made between two kinds of sediments: mineralized sediments and non-mineralized sediments. The invention intends to provide a sampling device suitable for taking a sample of non-mineralized sediments. Often samples of non-mineralized sediments are taken by driving a tube into the floor of the bore hole and subsequently extracting said tube with the obtained sample from the soil. However, the possibilities of driving a tube into the ground in a large variety of sediment types in a manner such as to allow the core to be recovered relatively intact, are limited.

Among the prior art methods of taking a soil sample in non-mineralized sediments are the following.

The drill hole may be drilled by rotating a steel pipe provided at its bottom end with a cutting shoe, whereby a compressive force is exerted on the cutting shoe for the cutting process. During rotation liquid is pumped down through the pipe taking away the cut material via the annular space between the drill pipe and the wall of the drilled hole. The cutting shoe at the lower end of the drill pipe has a central opening (or can be opened by removing a central part of the cutting shoe to facilitate the sampling process) such as to allow sampling equipment access to the sediment below the level of the cutting shoe. For application on land, the axial line of the drill pipe's interior is usually limited to 75 to 200 mm, and at sea to 75 to 100 mm. As a result, sampling apparatuses may only have a small diameter. The use of larger axial lines considerably increases the costs because it involves heavier drilling machines, more space and finally, at sea, the required vessels have to be of larger dimensions. Soil samples are taken by pushing or driving an open tube (sampling bush) into the floor of the hole by one of the following manners of operation.

In a first known method, the sampling bush is connected with a series of extension rods, while the surface of the rods are struck in order to drive the rods into the ground, see for example U.S. Pat. No. 5,211,248. This technique is also applied with subaqueous soils, the hammer operating inside a sleeve to guarantee the functioning of the hammer; see, for example WO 94/23181. With this manner of operation a variety of machines may be employed which are based on, for example, high-frequency and -efficiency hydraulic or pneumatic hammers. This technique is limited to a depth at which the energy can still be transmitted effectively via the extension rods between the surface and the bottom of the hole to the sampling bush. In practice this depth is several tens of meters in connection with energy reflections at the joints between individual rods, the limited rigidity of the rods, their susceptibility to bending, etc.

For greater depth, a second known technique reports the taking of samples using a very simple method of ramming, namely by using a falling weight that is hoisted up and down with the aid of a winch at the surface, and by letting this weight fall on an anvil fastened at the top side of the sampling bush.

The mass of the falling weight is limited by the small diameter of the drill pipe. Weights in the order of 50 to 100 kg are commonly used. The falling velocity is determined by the earth's gravitational force on the mass, reduced by retarding influences such as the resistance the falling weight experiences from the drilling liquid. The liquid under the falling weight has to be displaced and has to flow upward past the falling weight; this resistance is considerable, as the falling weight has to move in a very narrow space. The force required to counter the mass inertia of the winch drum and to pull the cable off the winch, and the resistance experienced by the winch cable from the drilling liquid, also play a role. Practice has shown that in very undeep drill holes considerable energy per stroke may be delivered. However, this greatly decreases with the length of the winch cable and consequently with the depth of the drill hole and, when drilling at sea, the depth of the drill hole increased with the distance of the ship to the sea floor. At a depth of 150 to 250 metres, depending on the mass used for the falling weight and the winch used, the energy is decreased to such an extent that by this manner of operation it is only possible to take samples of soft sediments.

Another aspect of this method when operating at sea relates to the effectiveness of the stroke force. Due to the rolling movement of the vessel the hoisting height of the falling weight and thus the falling height of the falling weight varies. As the available hoisting height in connection with the total allowable length of the apparatus is limited to 1 to 2 metres, it frequently happens when hoisting the falling weight, that the upper check of the hoisting height is reached and resulting in an upward stroke being made. This upward stroke has a very adverse effect on the quality of the sample to be taken. Another occurrence when using this technique at sea is that the precise depth of penetration at any moment is only known by approximation, so that after having been completely filled with sediment, it frequently happens that the sampling bush is driven even deeper into the ground, which also has a very adverse effect on the sample already taken.

Another disadvantage of this method is that the stroke frequency is very low due to the fact that the stroke force is delivered by hoisting the weight at the surface by means of a winch and waiting each time long enough to be certain that the falling weight has reached the check. In practice only one stroke per 5 to 15 seconds can be delivered.

In a third known technique samples are taken by driving the sampling bush into the sediment by means of a hydraulic jack. To this end the jack is temporarily anchored in the lower end of the drill pipe and driven by a liquid pumped down through a tube. Due to the small diameter it is possible with the usual liquid pressures to realize a compressive force of 50 to 100 kN.

In an alternative method of this known technique the drilling liquid is used as pressure medium. In this technique the drill pipe is sealed off at the lower end by the sampling apparatus, and the drilling liquid is compressed by means of a pump at the surface, for driving the hydraulic pressure device. In this method it is preferred that the pressure device be unmovable in relation to the floor of the hole. Therefore, at sea the drilling pipe in which the sampling apparatus is anchored, has to be vertically stabilized independently of the rolling movement of the vessel. Also, sufficient reactive force has to be supplied. To this end a scaffolding of adequate substance is lowered onto the sea bed and during sampling the drill pipe is clamped in this scaffolding. Simultaneously, the upper end of the drill pipe is kept in communication with the hoisting device aboard the vessel via a swell compensator.

One aspect of the quasi-statical driving of a sampling bush into the sediment relates to the friction the sampling bush applies to the entering sediment. This friction must be limited so as not to disturb the sample too much. In practice this means that the cutting depth is limited to 0.5 to 1.5 metres, depending on the type of sediment. In practice, the force that can be attained usually allows sufficiently long samples to be taken in solid clays and dense sands. In very hard clays and very dense sands, however, only slight penetration is realized.

From GB-A-2.142.364 an appartus is known for taking a soil sample comprising a drill pipe, a first driving gear for introducing the drill pipe into the soil, a sampling device comprising a sampling bush which movably fits into the drill pipe, and a hammer device, wherein the hammer device is movable in the drill pipe, and wherein on top of the sampling bush an anvil is provided whereby the hammer device is of the liquid-driven kind and serves as a second driving gear for introducing the sampling bush into the soil.

The sampling device of this known apparatus provides the advantage that it offers a high stroke frequency for driving the sampling bush in. As a result, driving the sampling bushes into clay-like soils, generates an elevated water tension in the sediment, which can greatly reduce the penetration resistance experienced by the sampling bush, thereby increasing the effectiveness of the apparatus. The fact that the hammer device according to the invention is provided directly above the sampling bush ("down the hole"), provides a very efficient and effective energy transmission which is independent of the depth at which sampling is to take place. Moreover, this apparatus is well suited for taking long samples.

The apparatus for taking a soil sample according to the invention is characterized in that the hammer device is provided with an internally extending sealable feed-through channel which is opened when a hammer element movable in the hammer device is resting on the anvil, and closed when the movable hammer element is at a distal position in relation to the anvil. In this manner the pressure that is built up above the hammer device simultaneously acts as drive force for said hammer device.

Conveniently, the hammer device is externally provided with a sealing member working together with the inside of the drill pipe, and the drill pipe can be sealed at its top. This allows a pressure to be built up within the space defined by the top of the hammer device and the drill pipe sealed at its top, which activates the hammer device. In addition, the movability of the hammer device in the drill pipe allows this pressure to boost the driving in of the sampling bush into the sediment.

Advantageously, the drill pipe is provided at its inside at a preadjusted height, with a grove for the interruption of the effect of the sealing member. When the sampling bush has reached the desired depth of penetration into the sediment, this provision allows the pressure above the hammer device to fall out, so that the sampling bush is fixed at its depth of penetration then reached.

It is furthermore useful that the feed-through channel of the hammer device runs through the hammer element, and that said feed-through channel comprises a valve which, when the hammer element is in the distal position, rests on said hammer element, thereby closing off the feed-through channel, and that inside the hammer device tappets are provided-on which the valve rests when the hammer member rests on the anvil, whereby then the feed-through channel is opened up.

In yet another aspect of the invention the apparatus is characterized in that the sampling bush, preferably at its top side, has one or more outwardly extendable projections, and that the drill pipe, at its lower end has an inwardly directed narrowing. After the sampling bush has completed its penetration into the sediment, said sampling bush can then be removed by simply pulling it out of the bottom of the drill hole simultaneously with the lifting of the drill pipe.

Preferably also the hammer device is at its upper end provided with a fish tail to allow said hammer device to be removed from the drill hole with the aid of a fishing apparatus.

In yet another aspect of the invention the sampling bush is embodied with an integrated deceleration element and above said deceleration element the sampling bush is provided with one or more outlet openings. This achieves that the liquid peak pressure in the sampling bush developing as it is being driven in is limited in said sampling bush, but above the sediment. The effect of this peak pressure is such that it reduces the drive-in efficiency of the sampling bush. In order to limit the peak pressure, the deceleration element ensures that during the driving in of the sampling bush, the liquid above the sediment in the sampling bush can leave the same as quickly as possible through the outlet openings.

In yet another aspect of the invention, the sampling bush is provided at its top side with a one-way valve located below the outlet openings in the sampling bush, which valve closes off when an underpressure exists in the sampling bush. This ensures that during the removal of the sampling bush from the sediment, the extracted sediment sample will remain as much as possible intact, due to the fact that during retraction of the sampling bush, the valve causes the creation of an underpressure above the sediment sample.

Usefully, the one-way valve is embodied as a heavy ball element resting on a seating. This effectively combines the above-discussed role of the valve with the previously-mentioned measure of the deceleration element limiting the peak pressure.

In an alternative embodiment the one-way valve is embodied as a ball element resting on a seating, and the deceleration element is coupled with the ball element. Preferably, the deceleration element defines a gas-filled chamber.

Another embodiment of the apparatus is characterized in that it is provided with a rod that can be fixed in the drill pipe and that extends through the sampling device, and which at the lower side of the sampling bush is provided with a piston element with a liquid-proof seal, while the sampling bush above the piston element is provided with openings. When the sampling bush accelerates downward, the piston element remains in place because the rod is fixed in relation to the drill pipe, and the liquid above the piston element is driven out of the sampling bush via the openings, so that the peak pressure has no effect on the entering sediment.

A possible embodiment of the apparatus according to the invention is characterized in that the sampling bush and the hammer device are embodied such as to be separate and separable.

Figure 2:
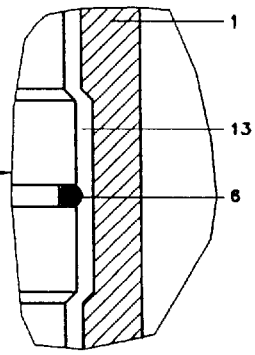
Figure 3:
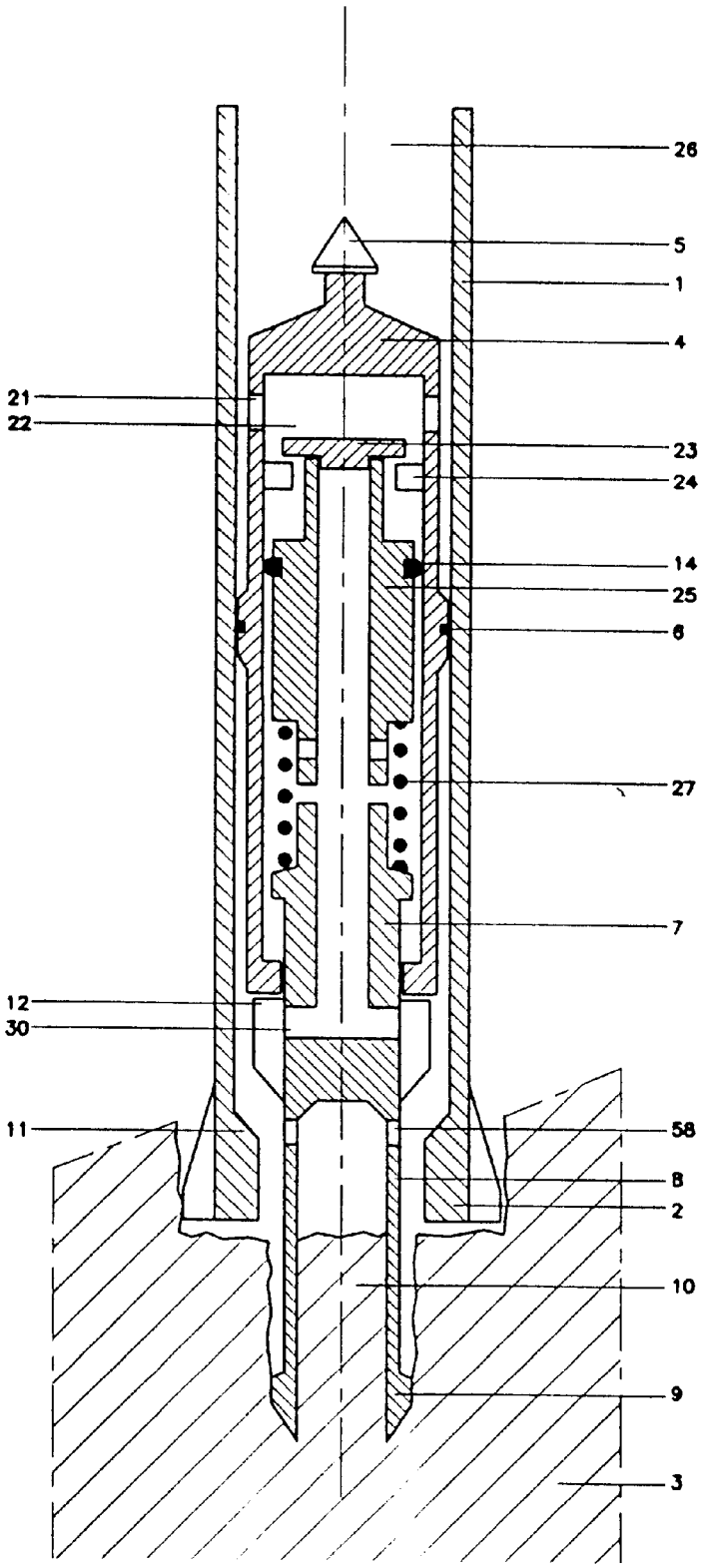
Figure 4:
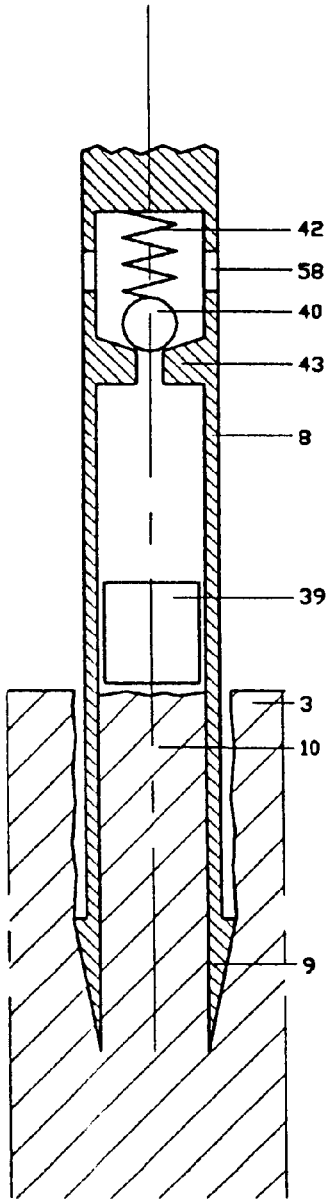
Figure 5:
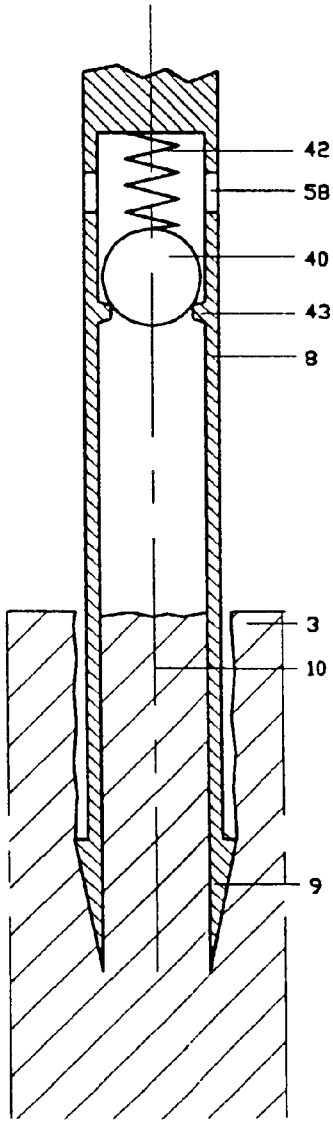
Figure 6:
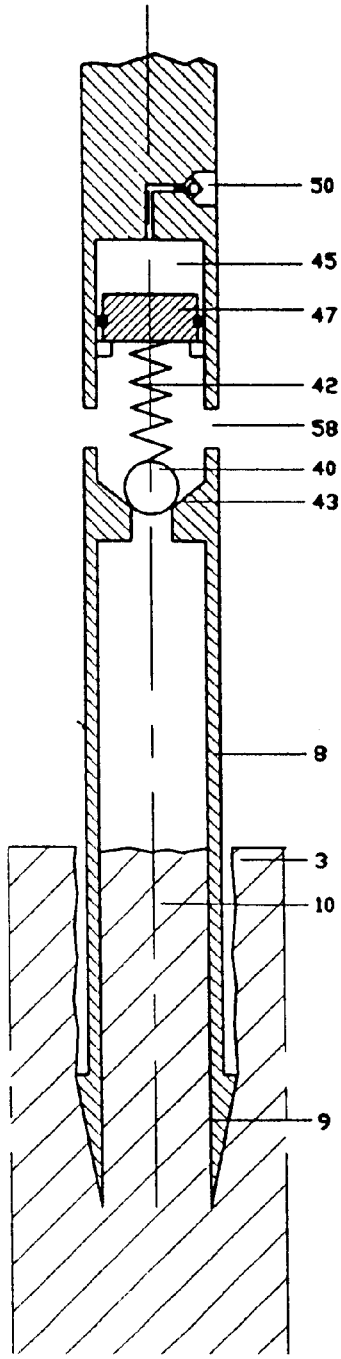
Figure 7:
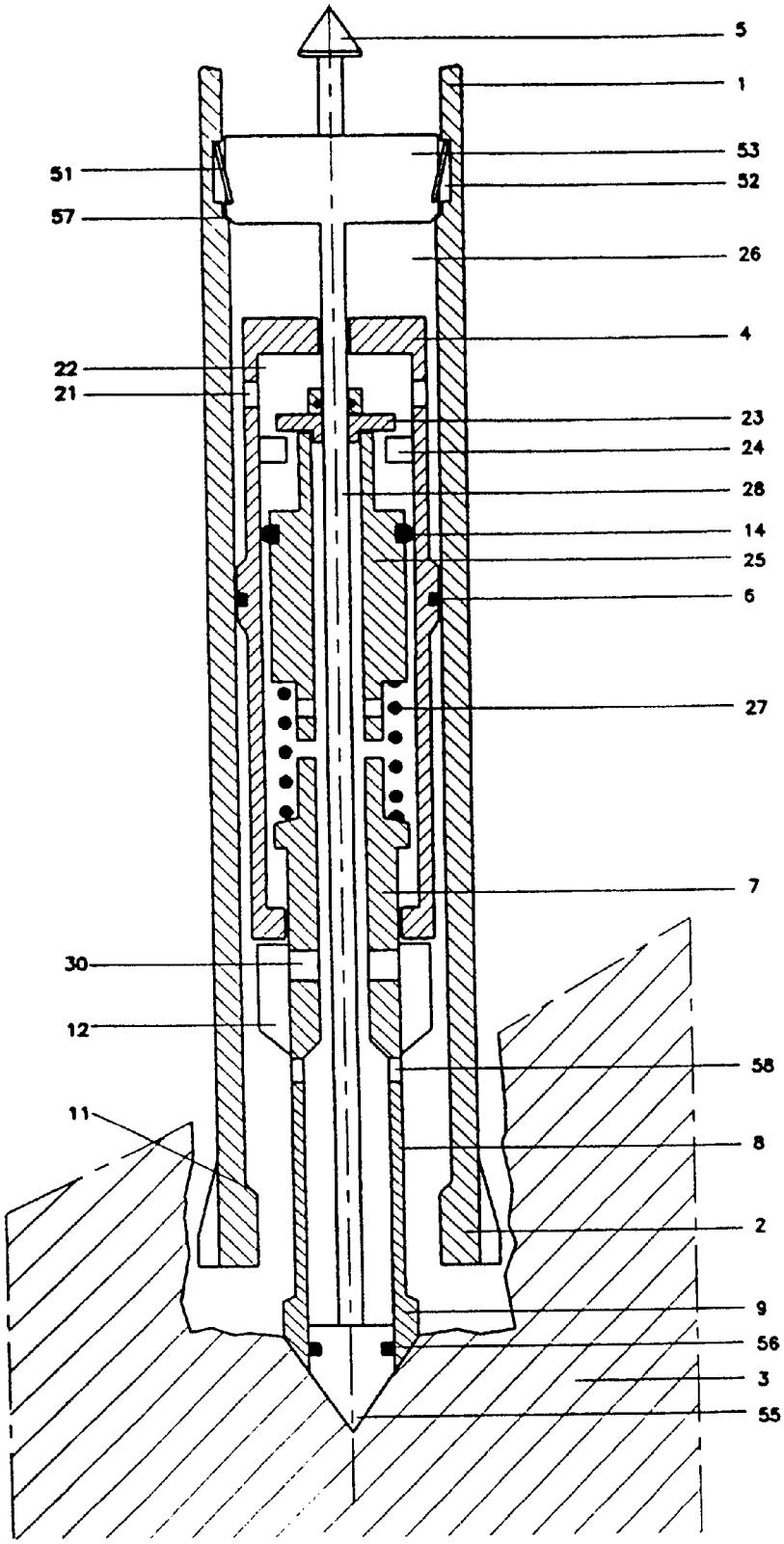

The invention will now be elucidated with reference to the drawing which in FIG. 1 shows a schematic view, partly in cross section, of the apparatus according to the invention;

in FIG. 2 shows an embodiment of a drill pipe for use in the apparatus according to the invention;

in FIG. 3 shows in more detail a first embodiment of the apparatus according to the invention;

in FIGS. 4, 5, and 6 shows different embodiments of the sampling bush according to the invention; and in FIG. 7 shows a second embodiment of the apparatus according to the invention.

Identical parts are indicated by the same reference numbers.

Referring first to FIG. 1, in which a drill pipe 1 is shown which at its underside is provided with a cutting shoe 2. This drill pipe 1 can be introduced in an otherwise known manner into a soil sediment 3. At the depth where the sample is to be taken, the drilling operation with the drill pipe 1 is arrested and the drill pipe 1 is in a known manner suspended from a vessel or the soil surface. A sampling device can then be lowered in the drill pipe 1 by free fall. The sampling device comprises a sampling bush 8 provided with an anvil 7, and a hammer device 4. The sampling bush 8 and the hammer device 4 may also be embodied as separate parts, separate from each other. Externally, the hammer device 4 is provided with a sealing member 6 which works together with the inside of the drill pipe 1. The drill pipe 1 can be sealed at the top (not shown). At its lower side the sampling bush 8 is provided with a cutting shoe 9. After the sampling device has come to rest on the floor of the drill hole, the drill pipe 1 is sealed at the top, and drilling liquid is pumped into the drill pipe 1 to provide a pressure in the space defined by the drill pipe 1 which is sealed at the top and the hammer device 4. The hammer device 4 is provided with means to be discussed below, which aids the liquid in passing the hammer device 4.

FIG. 2 shows the groove 13 that may be provided at the inside of the drill pipe 1 at a preadjusted height which corresponds with the desired depth of penetration of the sampling bush 8. When the sampling bush 8 has reached the desired depth, said groove 13 ensures that the sealing ring 6 becomes ineffective, so that the hammer device 4 is no longer operable.

The workings of the hammer device 4 will now be elucidated with reference to the FIGS. 3 and 7.

After sealing the top of the drill pipe 1, liquid in the space 26, usually water, is brought under pressure. Under certain conditions, said liquid is able to leave said space 26 via hammer device 4. To this end the hammer device 4 is provided with an internally extending but sealable feed-through channel which is opened when a hammer element 25 movable in the hammer device 4 is resting on the anvil 7, and which is closed when the movable hammer element 25 is at a distal position in relation to the anvil 7. To this end the hammer device 4 is provided with a valve body 23 to seal off the feed-through channel which also extends through the hammer element 25 when the hammer element 25 is in the distal position and which, when the hammer element 25 rests on the anvil 7, rests on tappets 24 provided in the interior of the hammer device 4, in such a manner that the feed-through channel is not closed off by the valve 23. The liquid which is under pressure in space 26, is then able via openings 21 to fill a space 22 in the hammer device 4 thereby, when the valve 23 is closed, exerting a pressure on the hammer element 25, resulting in the hammer element 25 being moved downward. Due to the application of a sealing O-ring 14 at the outside of the hammer element 25, the liquid cannot flow away. After the hammer element 25 has travelled a certain distance, the valve body 23 comes to rest on a seating having tappets 24, thereby allowing the liquid to flow through the interior of the hammer element 25 downward past the sealing member 6 and via openings 20 into the drill hole.

In the phase where the valve 23 is still closed, a fast downward movement is thus imposed on the hammer element 25, which movement continues after the valve 23 has opened due to the mass inertia of the hammer element 25, resulting in the hammer element 25 striking the anvil 7. Simultaneously, this movement depresses a spring 27 provided between the hammer element 25 and the anvil 7. The checking force on the anvil 7 experienced by the hammer element 25, causes the hammer element 25 to ricochet upward, boosted by the spring 27. After some time this upward movement of the hammer element 25 lifts the valve body 23 off the tappets 24 and the feed-through channel is closed, so that a new operating cycle can begin.

FIG. 7 shows the apparatus according to the invention in an alternative embodiment having a rod passing through, which at its top side is provided with a construction element 53 for locking the rod in a groove 52 in the drill pipe 1. At the lower side, the rod is provided with a piston element 55 fitting tightly into the cutter mouth of the sampling bush 8 and is provided with a liquid-proof seal 56. After lowering the hammer element 53 in the drill pipe 1, the construction element 53 rests on a ridge 57 in the drill pipe 1. In an otherwise known manner, pawls then come into operation which project into the groove 52 of the drill pipe 1. During the downward acceleration of the sampling bush 8, the rod passing through and the piston 55 remain unmovably in place, with the result that liquid present in the sampling bush 8 is driven out by the stationary piston 55 via openings 58.

FIGS. 1, 3, and 7 further show the narrowing 11 at the lower side of the drill pipe 1, as well as the outwardly extendable projections 12 on the outer circumference of the sampling bush 8. Said extendable projections 12 engaging the narrowing 11 at the lower side of the drill pipe 1 make that when the drill pipe 1 is being withdrawn, the sampling bush 8 is withdrawn with it. This movement activates certain apparatus components of the sampling bush 8, which will now be elucidated with reference to the FIGS. 4, 5, and 6. At the same time, the workings of components of said sampling bush 8 that are in operation when the sampling bush 8 is being driven into the soil sediment, will be elucidated.

In the FIGS. 4, 5, and 6 the sampling bush 8 is embodied, incorporating deceleration element 39, 40, and 47. Near the deceleration element outlet openings 58 are provided. As a result of the stroke of the hammer element 25 on the anvil 7, the sampling bush 8 undergoes a downward acceleration, resulting in its penetration into the sediment 3. The liquid present in the sampling bush 8 above the sediment column 10, drains away through the openings 58. Due to the sediment entering the sampling bush 8, the downward acceleration of the sampling bush 8 leads to a strong pressure peak in the liquid present in the sampling bush 8 above the sediment 10, unless further measures are taken. This hinders the sediment 10 from entering the sampling bush 8. To counteract the peak pressure in the liquid it is possible, for example as shown in FIG. 4, to incorporate in the sampling bush 8 a deceleration element 39 having a high specific density. When the sampling bush 8 accelerates downwardly, said deceleration element 39 is virtually motionless because of its mass inertia, thereby exerting a force on the liquid present above said deceleration element 39, as a result of which said liquid will drain away through the openings 58 more quickly. As shown in FIG. 5, the deceleration element 39 may also be embodied as a weighted ball 40 resting on a valve seating 43.

The valve 40, 43 shown in the FIGS. 4, 5, and 6, has the following function. While the sampling bush 8 is being withdrawn from the sediment, the sediment column 10 present in the sampling bush 8 undergoes a downward force due to suction in the sediment at the position of the cutting shoe 9. At the withdrawal of the sampling bush 8, the ball 40 rests on the seating 43, with the result that a vacuum is created under the valve 40, 43, thereby offering resistance to the vacuum formed at the position of the cutting shoe 9 of the sampling bush 8, and allowing the sample to be removed undamaged from the drill hole. The effect of the shut-off valve 40, 43 is enhanced by a spring 42 forcing the ball 40 onto its seating 43.

FIG. 6 shows an embodiment applying at the top side of the sampling bush 8 a chamber 45 filled with a gas at a pressure which is adjustable by means of a valve 50, which pressure is slightly lower than the pressure anticipated to occur in the liquid in the sampling bush 8 while the sampling bush 8 is being driven in. At its bottom side the chamber 45 is sealed by means of a heavy lid 47 made from a high-density material. The ball 40 is connected with said heavy lid 47. Since only a relatively small force is required for the compression of the gas present in the chamber 45, the lid 47 is virtually motionless during the downward acceleration of the sampling bush 8. The surplus liquid inside the sampling bush 8 can subsequently drain away via the openings 58.

What is claimed is:

1. An apparatus for taking a soil sample comprising a drill pipe, a first driving gear for introducing the drill pipe into the soil, a sampling device comprising a sampling bush which movably fits into the drill pipe, and a hammer device, wherein the hammer device is movable in the drill pipe, and wherein on top of the sampling bush an anvil is provided whereby the hammer device is of the liquid-driven kind and serves as a second driving gear for introducing the sampling bush into the soil, characterized in that the hammer device is provided with an internally extending sealable feed-through channel which is opened when a hammer element movable in the hammer device is resting on the anvil, and closed when movable hammer element is at a distal position in relation to the anvil, and the hammer device is externally provided with a sealing member working together with the inside of the drill pipe, and the drill pipe can be sealed at its top.

2. An apparatus for taking a soil sample comprising a drill pipe, a first driving gear for introducing the drill pipe into the soil, a sampling device comprising a sampling bush which movably fits into the drill pipe, and a hammer device, wherein the hammer device is movable in the drill pipe, and wherein on top of the sampling bush an anvil is provided whereby the hammer device is of the liquid-driven kind and serves as a second driving gear for introducing the sampling bush into the soil, characterized in that the hammer device is provided with an internally extending sealable feed-through channel which is opened when a hammer element movable in the hammer device is resting on the anvil, and closed when movable hammer element is at a distal position in relation to the anvil, and the hammer device is externally provided with a sealing member working together with the inside of the drill pipe, and the drill pipe can be sealed at its top, and the drill pipe is provided at its inside at a preadjusted height, with a groove for the interruption of the effect of the sealing member.

3. An apparatus for taking a soil sample comprising a drill pipe, a first driving gear for introducing the drill pipe into the soil, a sampling device comprising a sampling bush which movably fits into the drill pipe, and a hammer device, wherein the hammer device is movable in the drill pipe, and wherein on top of the sampling bush an anvil is provided whereby the hammer device is of the liquid-driven kind and serves as a second driving gear for introducing the sampling bush into the soil, characterized in that the hammer device is provided with an internally extending sealable feed-through channel which is opened when a hammer element movable in the hammer device is resting on the anvil, and closed when movable hammer element is at a distal position in relation to the anvil, and the feed-through channel of the hammer device runs through the hammer element, and that said feed-through channel comprises a valve which, when the hammer element is in the distal position, rests on said hammer element thereby closing off the feed-through channel, and that inside the hammer device tappets are provided on which the valve rests when the hammer member rests on the anvil, whereby the feed-through channel is opened up.

4. An apparatus according to claim 3, characterized in that the hammer device is at its upper end provided with a fish tail.

5. An apparatus for taking a soil sample comprising a drill pipe, a first driving gear for introducing the drill pipe into the soil, a sampling device comprising a sampling bush which movably fits into the drill pipe, and a hammer device, wherein the hammer device is movable in the drill pipe, and wherein on top of the sampling bush an anvil is provided whereby the hammer device is of the liquid-driven kind and serves as a second driving gear for introducing the sampling bush into the soil, characterized in that the hammer device is provided with an internally extending sealable feed-through channel which is opened when a hammer element movable in the hammer device is resting on the anvil, and closed when movable hammer element is at a distal position in relation to the anvil, and the sampling bush is embodied with an integrated deceleration element, and that near said deceleration element the sampling bush is provided with one or more outlet openings.

6. An apparatus for taking a soil sample comprising a drill pipe, a first driving gear for introducing the drill pipe into the soil, a sampling device comprising a sampling bush which movably fits into the drill pipe, and a hammer device, wherein the hammer device is movable in the drill pipe, and wherein on top of the sampling bush an anvil is provided whereby the hammer device is of the liquid-driven kind and serves as a second driving gear for introducing the sampling bush into the soil, characterized in that the hammer device is provided with an internally extending sealable feed-through channel which is opened when a hammer element movable in the hammer device is resting on the anvil, and closed when movable hammer element is at a distal position in relation to the anvil, and the sampling bush is provided at its top side with a one-way valve located below the outlet openings in the sampling bush, which valve closes off when an under pressure exists in the sampling bush.

7. An apparatus according to claim 6, characterized in that the one-way valve is embodied as a heavy ball element resting on a seating.

8. An apparatus according to claim 6, characterized in that the one-way valve is embodied as a ball element resting on a seating, and in that the deceleration element is coupled with the ball element.

9. An apparatus according to claim 8, characterized in that the deceleration element defines a gas-filled chamber.

10. An apparatus for taking a soil sample comprising a drill pipe, a first driving gear for introducing the drill pipe into the soil, a sampling device comprising a sampling bush which movably fits into the drill pipe, and a hammer device, wherein the hammer device in the drill pipe, and wherein on top of the sampling bush an anvil is provided whereby the hammer device is of the liquid-driven kind and serves as a second driving gear for introducing the sampling bush into the soil, characterized in that the hammer device is provided with an internally extending sealable feed-through channel which is opened when a hammer element movable in the hammer device is resting on the anvil, and closed when movable hammer element is at a distal position in relation to the anvil, and further characterized in that the same is provided with a rod that can be fixed in the drill pipe and that extends through the sampling device, and which at the lower side of the rod is provided with a piston element with a liquid-proof seal, while the sampling bush above the piston element is provided with openings.

11. An apparatus for taking a soil sample comprising a drill pipe, a first driving gear for introducing the drill pipe into the soil, a sampling device comprising a sampling bush which movably fits into the drill pipe, and a hammer device, wherein the hammer device is movable in the drill pipe, and wherein on top of the sampling bush an anvil is provided whereby the hammer device is of the liquid-driven kind and serves as a second driving gear for introducing the sampling bush into the soil, characterized in that the hammer device is provided with an internally extending sealable feed-through channel which is opened when a hammer element movable in the hammer device is resting on the anvil, and closed when movable hammer element is at a distal position in relation to the anvil, and the sampling bush and the hammer device are embodied such as to be separate and separable.

* * * * *